US011039668B2

(12) United States Patent
Ortale, IV

(10) Patent No.: US 11,039,668 B2
(45) Date of Patent: Jun. 22, 2021

(54) SLACK REDUCING DEVICE FOR MODELING A WATCH

(71) Applicant: William P. Ortale, IV, Nashville, TN (US)

(72) Inventor: William P. Ortale, IV, Nashville, TN (US)

( * ) Notice: Subject to any disclaimer, the term of this patent is extended or adjusted under 35 U.S.C. 154(b) by 51 days.

(21) Appl. No.: 16/388,055

(22) Filed: Apr. 18, 2019

(65) Prior Publication Data

US 2020/0329830 A1 Oct. 22, 2020

(51) Int. Cl.
*A44C 5/00* (2006.01)

(52) U.S. Cl.
CPC ..... *A44C 5/0007* (2013.01); *A44C 5/0084* (2013.01)

(58) Field of Classification Search
CPC ..... A44C 5/0007; A44C 5/00; A44C 5/14; A44C 5/0084; G04B 37/005; A45F 2005/008
USPC ..... 224/171
See application file for complete search history.

(56) References Cited

U.S. PATENT DOCUMENTS 2,114,466 A 4/1938 Fletcher
2,546,859 A 3/1951 Innes
2,649,230 A * 8/1953 Thompson ..... G04B 37/005 368/286
2,895,658 A * 7/1959 Dzus ..... A44C 5/00 224/171
3,149,452 A 9/1964 Smith
3,483,717 A 12/1969 Mayer
3,610,488 A * 10/1971 Tracy ..... A44C 5/00 224/171
5,068,840 A * 11/1991 Buckner ..... G04B 37/0058 368/281
5,628,208 A * 5/1997 Rood ..... A44C 9/02 63/15.5
6,499,875 B1 12/2002 Telly
(Continued)

FOREIGN PATENT DOCUMENTS

JP 3191332 U 6/2014
JP 5979769 B1 8/2016
(Continued)

OTHER PUBLICATIONS

International Search Report and Written Opinion for corresponding PCT/US2020/024463, dated Jul. 6, 2020, 11 pages.

*Primary Examiner* — Corey N Skurdal
(74) *Attorney, Agent, or Firm* — Pattterson Intellectual Property Law, P.C.; Ryan D. Levy; Alex H. Huffstutter

(57) ABSTRACT

An apparatus for positioning between a wristwatch and a user's wrist is provided to aid in modeling wristwatches. The apparatus includes a spacer and a connection means (e.g., a band, a magnet, or the like). The spacer is configured to be positioned between a lower watchband portion of the wristwatch and a lower wrist portion of the user's wrist. The spacer may be resilient and may include an arcuate outer support surface configured to rest against an inner surface of a watchband of the wristwatch. The spacer is held in said position using the connection means. The band is implemented to create a passageway for receiving the user's wrist for holding the apparatus securely around the user's wrist. The apparatus may further include a cover configured to cover at least the spacer for hygienic, aesthetic, and non-slip purposes.

21 Claims, 14 Drawing Sheets

(56) References Cited

U.S. PATENT DOCUMENTS

| | | | | |
|---|---|---|---|---|
| 9,775,413 | B1 * | 10/2017 | Ingimundarson | A45D 8/00 |
| D832,132 | S * | 10/2018 | Ansara | D11/86 |
| 2009/0135681 | A1 | 5/2009 | Lawson | |

FOREIGN PATENT DOCUMENTS

| | | | |
|---|---|---|---|
| KR | 2019980026044 | U | 8/1998 |
| KR | 1020010097231 | A | 11/2001 |

* cited by examiner

SLACK REDUCING DEVICE FOR MODELING A WATCH

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present invention relates generally to temporary wristwatch accessories. More particularly, this invention pertains to an apparatus and method for adjusting the fit of a wristwatch having a watchband with a predetermined circumference larger than a wrist circumference of a user.

BACKGROUND

Modeling wristwatches for the purposes of deciding whether to purchase a particular wristwatch can be a frustrating experience, especially when the watchband is not fitted to the user's wrist. This is particularly relevant for wristwatches with watchbands that cannot be easily adjusted. One such type of watchband that cannot be easily adjusted for the purpose of modeling or merely trying on the wristwatch is a metal watchband. Metal watchbands may have a clasp along a base portion and may be fitted to a user's wrist by removing or adding metal links from or to the metal watchband. This can be time-consuming, not only to remove the link but also to put them back should the user decide not to purchase the particular wristwatch.

Wristwatches having metal watchbands are typically manufactured to standard circumferences (e.g., as the wristwatch comes from the factory and as it sits on retail shelves). For men, the standard wristwatch circumference measures between 7.5 inches and 9.5 inches (or approximately 19.1 cm and 24.1 cm), depending on the style and manufacturer. For women, the standard wristwatch circumference is between 6.5 inches and 8 inches (or approximately 16.5 cm and 20.3 cm), again, depending on the style and manufacturer. Watchband widths typically range in size between 0.3 inch and 1.3 inches (or approximately between 8 mm and 33 mm). Some speciality watchbands can be much larger or smaller.

The average wrist size of a man is 7.3 inches (or approximately 18.5 cm). Additionally, 95% of men have a wrist size (i.e., a wrist circumference) between 5.8 inches and 8.7 inches (or approximately 14.7 cm and 22.1 cm). The average wrist size of a woman is 6.2 inches (or approximately 15.7 cm. Additionally, 95% of women have a wrist size between 5 inches and 7.5 inches (or approximately 12.7 cm to 19.1 cm. Accordingly, it is easy to see that many standard sized wristwatches will be too large for both men and women without having at least some adjustment made. This is especially true considering recent trends of women shoppers purchasing larger watches and sometimes even men's watches.

Ideally, the user desires the case of the wristwatch to rest securely along an upper portion of the user's wrist. This, however, is not the case when modeling a wristwatch that is not fitted to the user's wrist (i.e., the watchband of the wristwatch is too large). Based on the above average size ranges, it is all too common for a wristwatch to be larger than a user's wrist when modeling or trying on a standard sized wristwatch.

Modeling a wristwatch when deciding whether to purchase it may involve movements of the user's arm, wrist, and hand that allow the user may see how the watch looks on the user's wrist when the user's arm, wrist, and/or hand are in different positions. This movement may cause the wristwatch to shift along and rotate around the user's wrist, and even slide down onto the user's hand, which could negatively affect the user's perception of the wristwatch. The movement may also be dangerous if the wristwatch impacts and injures the user's hand.

The frustration with modeling wristwatches is two-fold. First, potential purchasers of a wristwatch want ideal conditions to be present (i.e., the wristwatch to be fitted to the potential purchaser's wrist) when trying the wristwatch on. A wristwatch that is constantly moving and shifting along the potential purchaser's wrist results in the potential purchaser not being able to properly evaluate the wristwatch. This may further affect the potential purchaser's decision whether to purchase a particular wristwatch. One solution a potential purchaser might try is to hold the wristwatch stationary on the wrist using the opposite, free, hand.

Second, retailers may be frustrated that no legitimate solution exists for securely holding the case of a wristwatch along the upper portion of the user's wrist when the watchband is not fitted to the user's wrist, besides removing links of the watchband. Retailers may also become frustrated if they learn that the loose fit altered the potential purchaser's perception of the wristwatch and thus caused them to decide not to purchase a particular wrist watch. Finally, retailers could also become frustrated when they remove links to custom fit a wristwatch to a potential purchaser's wrist and the potential purchaser decides not to purchase the wristwatch. Also, metal tools and fittings are used to resize a wristwatch and this can lead to costly scratching of said wristwatch.

BRIEF SUMMARY

What is needed, then, is a solution for securely holding the case of a wristwatch along the upper portion of the user's wrist when the watchband is not fitted to the user's wrist for the purposes of modeling the wristwatch prior to purchase. It is one object of the present disclosure to provide an apparatus for supporting a wristwatch on a user's wrist. The apparatus may include a spacer configured to fill a space between a lower portion of the user's wrist and the watchband so as to enable secure placement of the case of the wristwatch along the upper portion of the user's wrist. The apparatus may further include an attachment means, such as a band, for securely holding the spacer along the lower portion of the user's wrist. The apparatus may also include a cover configured to surround the spacer for aesthetic and hygienic purposes. The apparatus provides a short-term quick and easy solution to trying on the wristwatch prior to a potential purchase.

According to one aspect of the present disclosure, there is provided an apparatus for positioning between a watch and a user's wrist. The apparatus is comprised of a spacer and a band. The spacer is configured to be positioned between a base portion of a watchband of the watch and a lower portion of the user's wrist. The band is couplable to the spacer. The band is configured to at least partially define a passageway configured to receive the user's wrist for holding the spacer along the lower portion of the user's wrist.

According to another aspect of the apparatus of the present disclosure, the spacer includes a first spacer end, a second spacer end, a spacer width, a first support surface, and a second support surface. The first and second support surfaces are defined between the first spacer end and the second spacer end. The first spacer support surface is defined by a first radius of curvature.

According to another aspect of the apparatus of the present disclosure, the second spacer support surface is defined by a second radius of curvature. The first radius of curvature is smaller than the second radius of curvature.

According to another aspect of the apparatus of the present disclosure, a variable spacer thickness is defined between the first support surface and the second support surface. The variable spacer thickness is defined perpendicularly to the second support surface and spans a majority of the second support surface between the first spacer end and the second spacer end.

According to another aspect of the apparatus of the present disclosure, a maximal uncompressed spacer thickness is defined between the first support surface and the second support surface approximately midway between the first spacer end and the second spacer end.

According to another aspect of the apparatus of the present disclosure, the maximal uncompressed spacer thickness is less than or equal to 3 inches.

According to another aspect of the apparatus of the present disclosure, optimally the spacer width is less than or equal to the width of the watchband of the watch, though some watch bands may be so thin (width-wise) that this is not feasible. Additionally, the spacer width may be greater than or equal to 0.3 inch and less than or equal to 2 inches.

According to another aspect of the apparatus of the present disclosure, the band extends between the first and second spacer ends.

According to another aspect of the apparatus of the present disclosure, the spacer includes a pair of ridges extending radially from the first support surface of the spacer positioned adjacent a first edge and a second edge of the first support surface, respectively. The first and second edges spanning between the first spacer end and the second spacer end.

According to another aspect of the apparatus of the present disclosure, the pair of ridges are spaced apart by a ridge spacing width. According to this aspect, the ridge spacing width is greater than or equal to a watchband width of the base portion of the watchband.

According to another aspect of the apparatus of the present disclosure, the band is resilient.

According to another aspect of the apparatus of the present disclosure, the passageway has a circumference greater than or equal to 3 inches and less than or equal to 12 inches.

According to another aspect of the apparatus of the present disclosure, the band and the spacer define an outer perimeter having a perimeter distance greater than or equal to 4 inches and less than or equal to 14 inches.

According to another aspect of the apparatus of the present disclosure, at least a portion of a circumference of the passageway is defined by the band. In accordance with this aspect, a majority of the portion of the circumference defined by the band has a band width that is less than or equal to a watchband width of the watchband of the watch. Additionally, the band width may be less than or equal to 2 inches.

According to another aspect of the apparatus of the present disclosure, the band width varies along a majority of the portion of the circumference defined by the band.

According to another aspect of the apparatus of the present disclosure, the apparatus further comprises a cover configured to surround and protect the spacer.

According to another aspect of the apparatus of the present disclosure, the cover is configured to couple the spacer and the band together.

According to another aspect of the apparatus of the present disclosure, the band includes a non-slip outer surface. The non-slip outer surface may be configured to engage the watch when worn on the user's wrist.

According to another aspect of the apparatus of the present disclosure, the band includes an outer surface having a non-slip material disposed thereon. The non-slip material may be configured to engage the watch when the worn on the user's wrist.

According to further aspects of the present disclosure, there is provided a watch accessory for supporting a wristwatch on a user's wrist. The watch accessory is comprised of a spacer, a cover, and an attachment means. The spacer has a first spacer end, a second spacer end, a first spacer surface, and a second spacer surface. The first and second spacer surfaces span between the first spacer end and the second spacer end. The first spacer surface is defined by a first radius of curvature. The cover is configured to surround the spacer. The cover has first and second cover ends corresponding to the first and second spacer ends. The attachment means is provided for positioning the spacer between an underside of the user's wrist and a watchband of the wristwatch According to another aspect of the watch accessory of the present disclosure, the attachment means comprises at least one magnet positioned between first spacer surface and the cover. The at least one magnet is configured to couple to an interior surface of the watchband.

According to another aspect of the watch accessory of the present disclosure, the attachment means comprises a band having a first band end and a second band end. The first band end is coupled to one of the first spacer end or the first cover end. The second band end coupled to one of the second spacer end or the second cover end.

According to another aspect of the watch accessory of the present disclosure, the band includes a linkage coupled between the first band end and the second band end. The linkage is configured to be positioned between the second spacer surface and the cover.

According to still further aspects of the present disclosure, there is provided a method for modeling a wristwatch on a user's wrist. The wristwatch has an interior circumference that is greater than an exterior circumference of the user's wrist. The method comprises selecting a spacer device from a plurality of spacer devices having differing maximal uncompressed spacer thicknesses defined between first and second spacer surfaces. The selected spacer has a maximal uncompressed spacer thickness greater than or equal to a maximal gap distance defined between a lower wrist portion of the user's wrist and a lower watchband portion of the wristwatch. The method further comprises positioning the selected spacer between the lower wrist portion of the user's wrist and the lower watchband portion of the wristwatch for holding a display portion of the wristwatch proximate to and securely along an upper wrist portion of the user's wrist.

According to another aspect of the method of the present disclosure, the method further comprises positioning the user's wrist through a passageway defined at least partially by a band coupled to the spacer, and positioning the wristwatch and the watchband around the spacer and the band.

According to another aspect of the method of the present disclosure, the method further comprises disposing a non-slip material along at least a portion of an outer band surface of a band coupled to the spacer for maintaining a position of the wristwatch and the watchband.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining objects including, but not limited to, the use of any fasteners such as screws, nuts and bolts, bolts, pin and clevis, needle and thread, Velcro (e.g., hooks and loops) and the like allowing for a stationary, translatable, or pivotable relationship; as well as indirect or direct contact.

Unless specifically stated otherwise, any part of the apparatus of the present disclosure may be made of any appropriate or suitable material including, but not limited to, metal, alloy, polymer, polymer mixture, wood, composite, a variety of fabrics, vinyl, leather, a variety of different resiliently flexible materials or elastomers, or any combination thereof.

Figure 1:
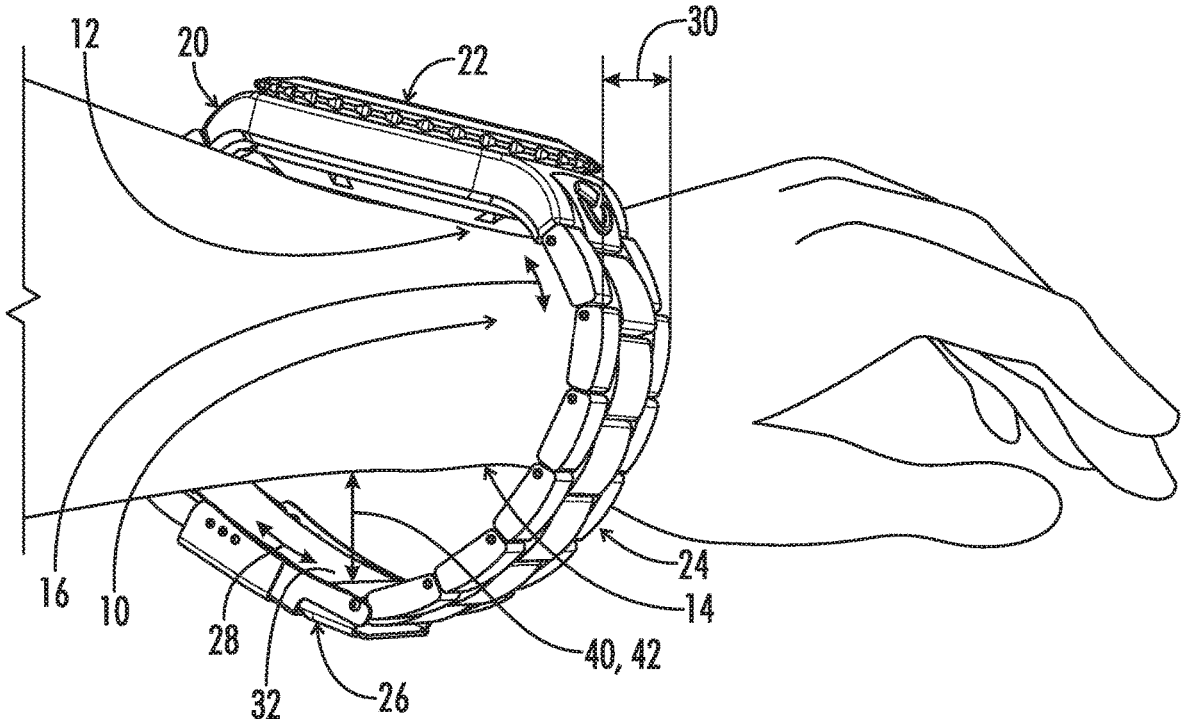
FIG. 1 illustrates a perspective view of a wristwatch on a user's wrist, the wristwatch has an interior circumference that is greater than an exterior circumference of the user's wrist.

Referring to FIG. 1, a wristwatch 20 (e.g., a watch) is shown being worn on a user's wrist 10. The wristwatch 20 includes a case 22 and a watchband 24. The case 22 may also be referred to herein as a display portion 22. The case 22 of the wristwatch 20 is configured to rest along an upper wrist portion 12 of the user's wrist 10. As illustrated, a gap 40 is defined between a lower wrist portion 14 (e.g., an underside 14 or a lower portion 14) of the user's wrist 10 and a lower watchband portion 26 (e.g., a base portion 26 where the clasp of the watchband 24 is generally located) of the watchband 24 of the wristwatch 20. Accordingly, the wristwatch 20 is not fitted to the user's wrist 10 (e.g., the wristwatch 20 has an interior circumference 28 that is larger than a wrist circumference 16 of the user's wrist 10). The gap 40 allows the wristwatch 20 to move and shift excessively on the user's wrist 10. This movement of the wristwatch 20 may be a substantial factor in why modeling or trying on wristwatches can be a frustrating experience. The gap 40 may have a maximal gap distance 42.

Figure 2:
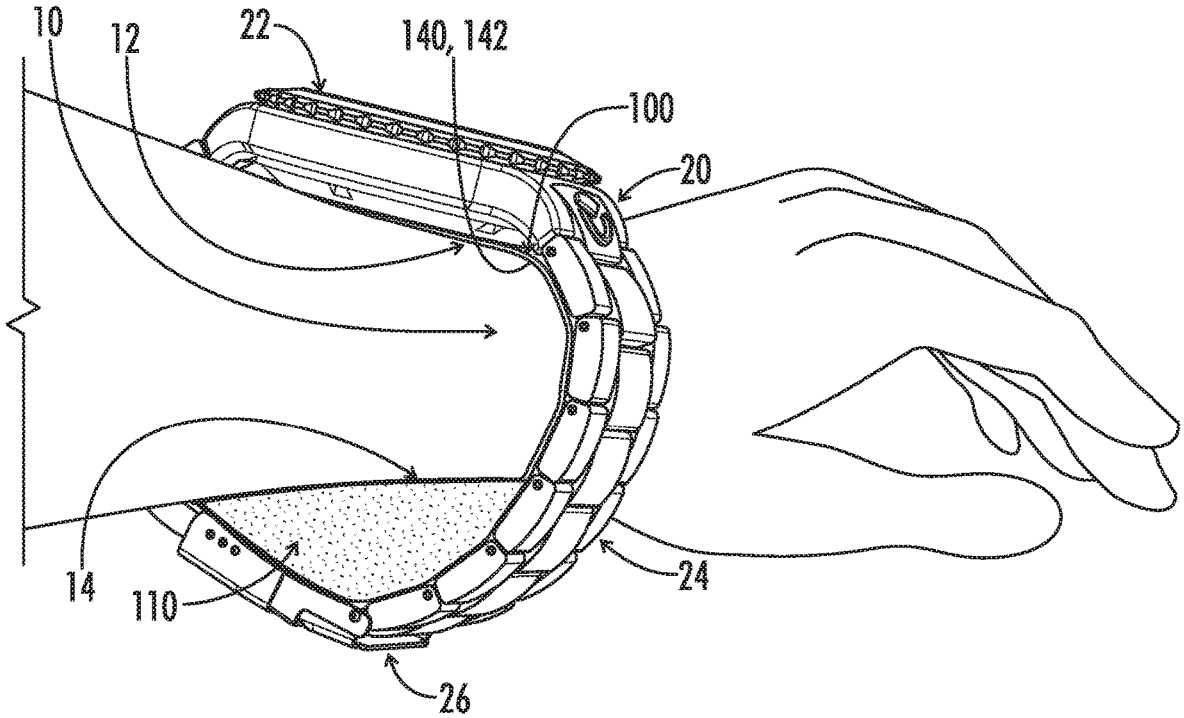
FIG. 2 illustrates a perspective view of an apparatus positioned between a wristwatch and a user's wrist in accordance with the present disclosure.
Figure 3:
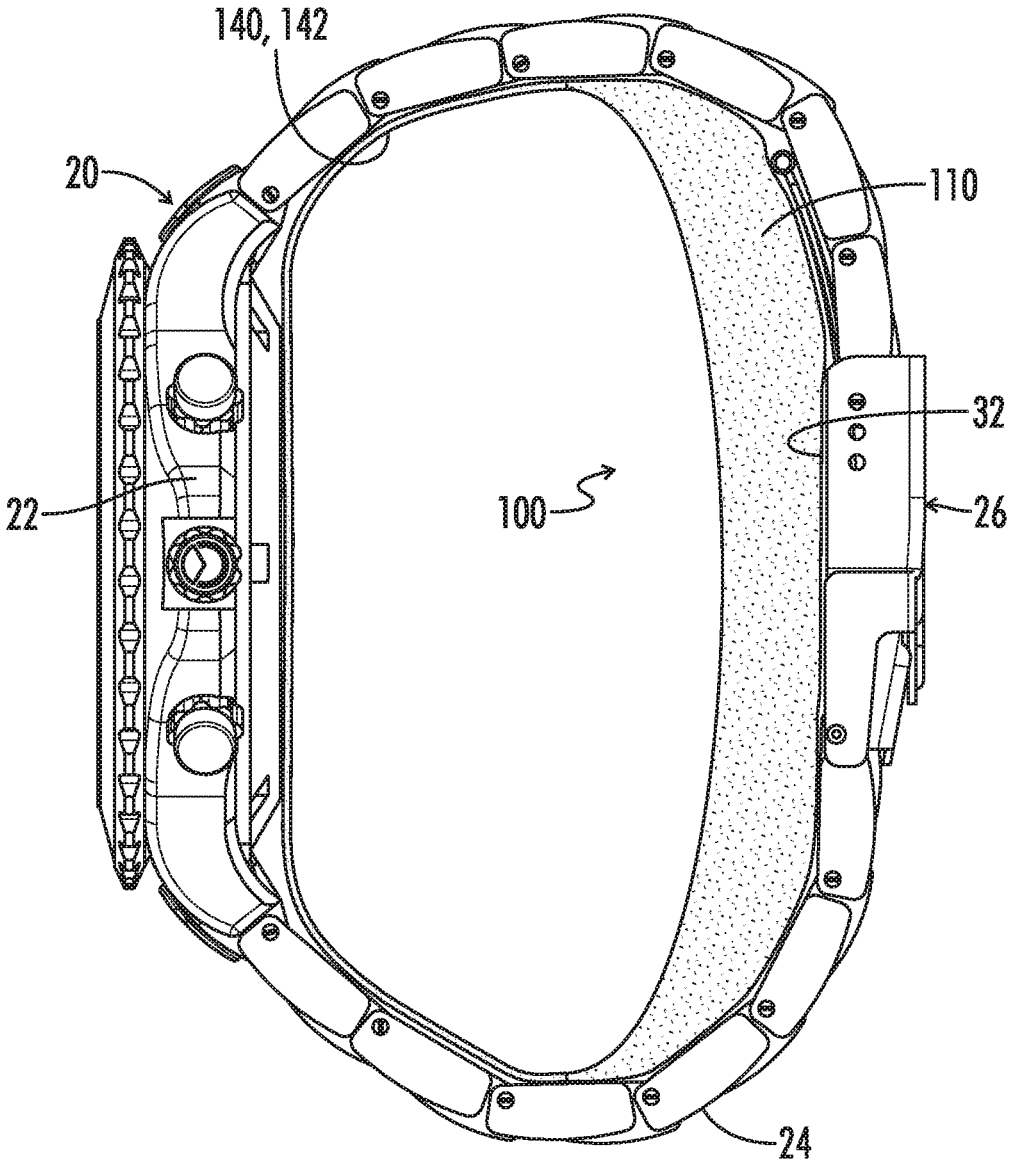
FIG. 3 illustrates a side elevational view of the apparatus of FIG. 2 in combination with the wristwatch in accordance with the present disclosure.
Figure 4A:
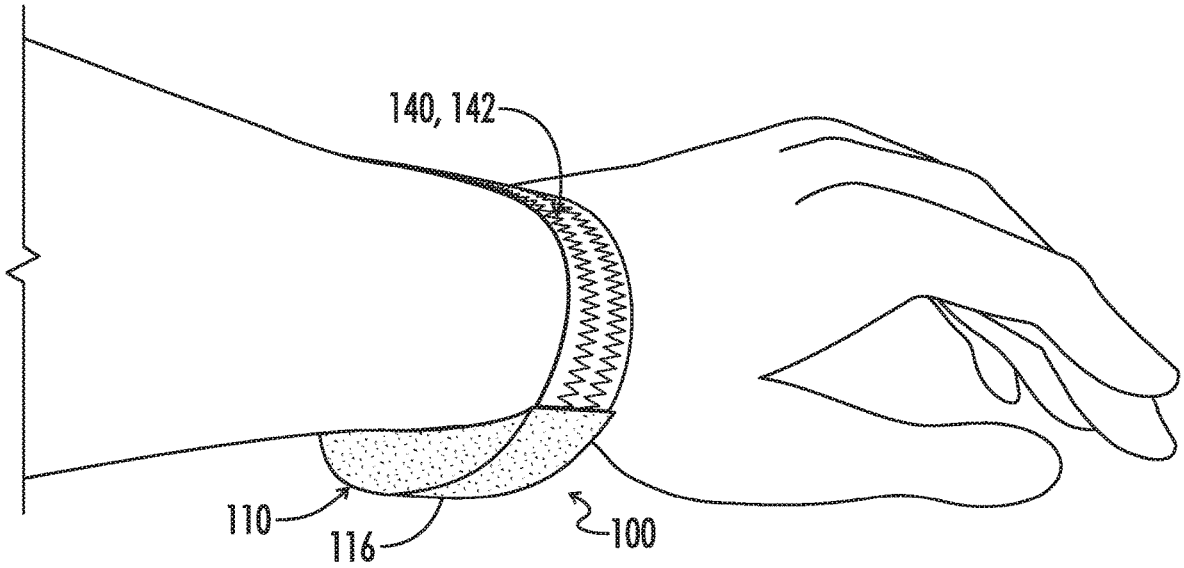
FIG. 4A illustrates a perspective view of the apparatus of FIG. 2 positioned around a user's wrist in accordance with the present disclosure.

Referring now to FIGS. 2-15, an apparatus 100 is provided for positioning between the wristwatch 20 and the user's wrist 10. The apparatus 100 may also be referred to herein as a watch accessory 100. The apparatus 100 comprises at least a spacer 110 and an attachment means 140 for positioning the spacer 110 between the lower wrist portion 14 of the user's wrist 10 and the lower watchband portion 26 of the watchband 24 of the wristwatch 20. The spacer 110 may also be referred to herein as a spacer device 110. The apparatus 100 is configured to maintain an optimal position of the wristwatch 20 on the user's wrist 10 such that the case 22 of the wristwatch 20 is securely positioned along the upper wrist portion 12 of the user's wrist 10, as shown in FIG. 2, without having to remove links from the watchband 24. As can best be seen in FIG. 4A, the apparatus 100 is shown on the user's wrist 10 without the wristwatch 20 positioned thereupon.

As can best be seen in FIGS. 4B-5 and 8A-14, the spacer 110 includes a first spacer end 112, a second spacer end 114, a first spacer surface 116 (i.e., a first support surface 116), and a second spacer surface 118 (i.e., a second support surface 118). The first and second spacer surfaces 116, 118 are defined between the first and second spacer ends 112, 114. The first spacer surface 116 may be configured to support (or may be associated with) the lower watchband portion 26 of the watchband 24. The second spacer surface 118 may be configured to support (or may be associated with) the lower wrist portion 14 of the user's wrist 10.

Figure 8A:
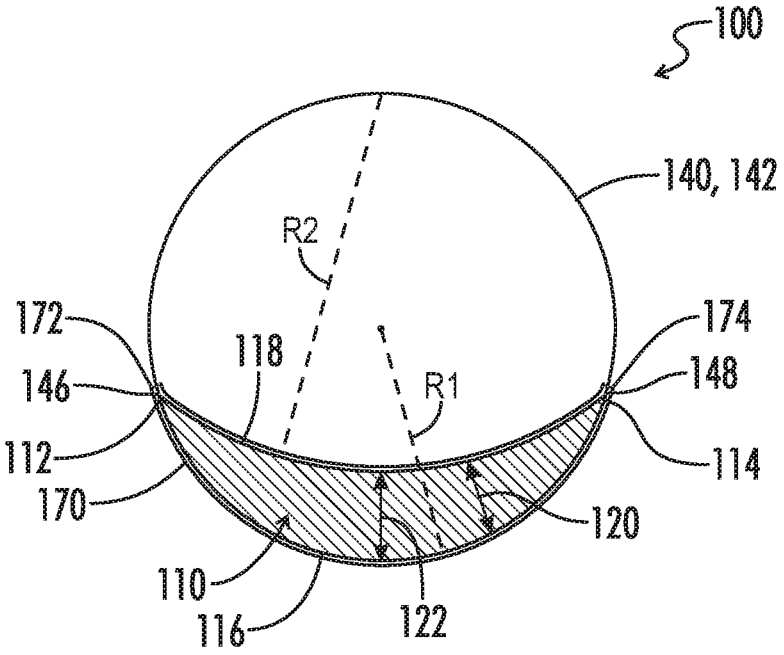
FIG. 8A illustrates a cross-sectional view of the apparatus of FIG. 4 taken along line 8A-8A of FIG. 4.
Figure 8B:
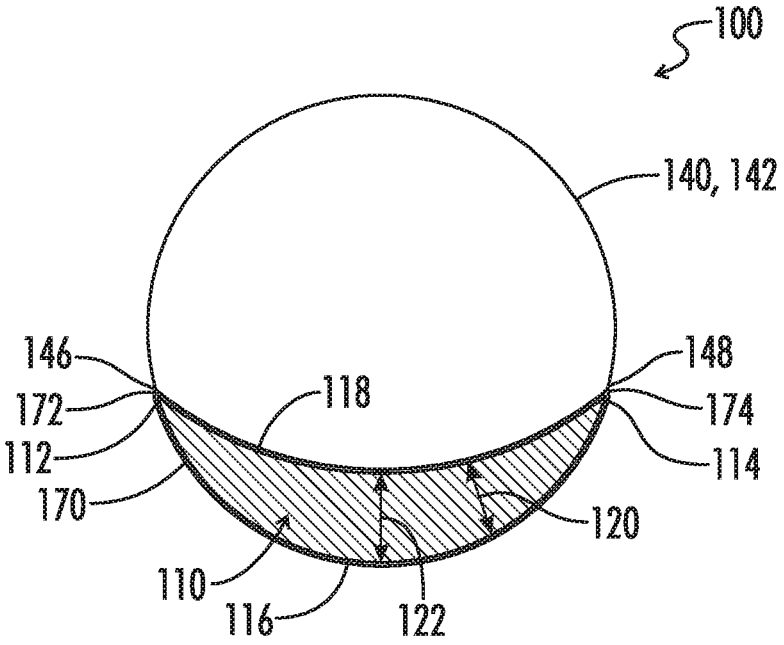
FIG. 8B illustrates a cross-sectional view of an alternate embodiment of the apparatus of FIG. 8A in accordance with the present disclosure.

As can best be seen in FIG. 8A, the first spacer surface 116 may be defined by a first radius of curvature R1. The first radius of curvature R1 is defined such that the first spacer surface 116 has a convex shape. The first radius of curvature R1 may be within a range of approximately 0.5 inch to 3 inches (including the outer limits).

The second spacer surface 118 may be defined by a second radius of curvature R2. The second radius of curvature R2 is defined such that the second spacer surface 118 has a concave shape. The second radius of curvature R2 may be larger than (or greater than) the first radius of curvature R1.

Figure 9A:
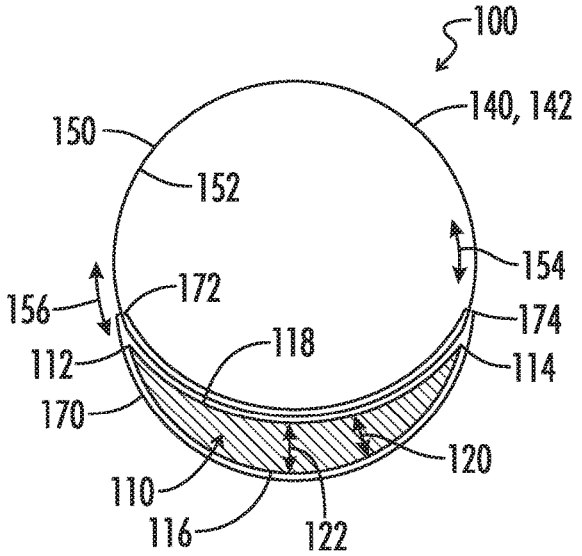
FIGS. 9A-9D illustrate cross-sectional views of alternate embodiments of the apparatus of FIG. 8A in accordance with the present disclosure.
Figure 9B:
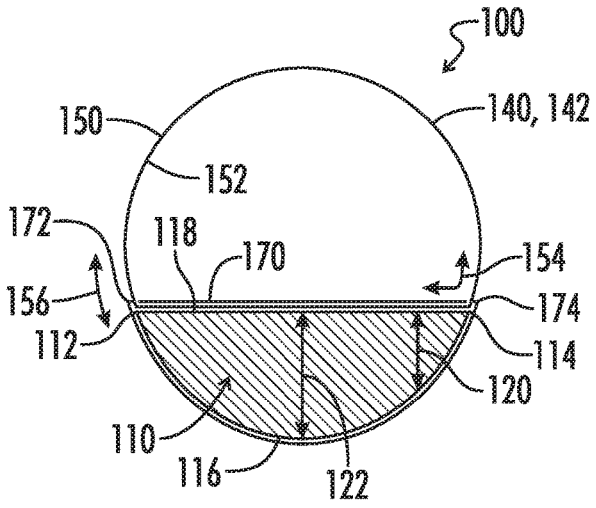
Figure 9C:
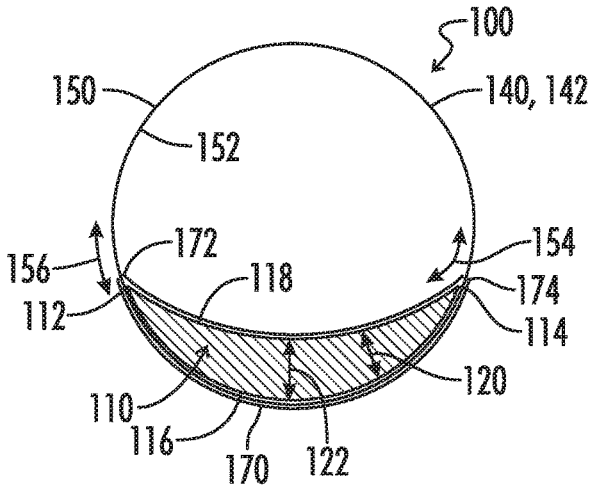
Figure 9D:
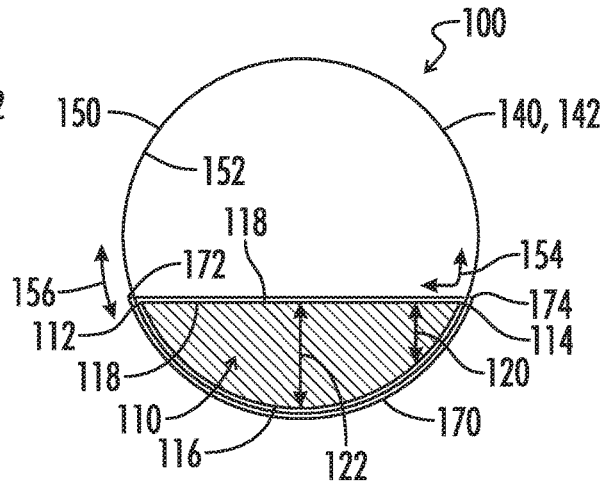

Alternatively, as can best be seen in FIGS. 9B and 9D, the second spacer surface 118 may be linear. In order embodiments (not shown), the second spacer surface 118 may even be convex shaped.

In certain embodiments (not shown), the spacer 110 has no pre-molded radius of curvature. In such instances the radius of curvature is defined along the spacer 110 by the user's wrist 10.

The spacer 110 may be formed from a resilient material (e.g., memory foam or the like) such that when positioned between the user's wrist 10 and the watchband 24 of the wristwatch 20, the spacer 110 deforms to fit in the gap 40 defined therebetween. The resilient material should ideally be form-fitting, moldable, cuttable, and shapeable and such that it is able to return to its original shape once pressure is removed. The resilient material from which the spacer 110 is formed may be one or a combination of a variety of different resiliently flexible materials or elastomers such as unsaturated rubbers, saturated rubbers, viscoelastics, gel infused viscoelastics, various other types of elastomers (e.g., thermoplastic-elastomers (TPE), -vulcanizates (TPV), -polyurethane (TPU), -olefines (TPO), resilin and elastin, polysulfide rubber, or the like), or other resiliently flexible materials. Unsaturated rubbers may include natural rubber (NR), synthetic polyisoprene (IR), butyl rubber (copolymer of isobutylene and isoprene, IIR), halogenated butyl rubbers (Chloro Butyl Rubber: CIIR; Bromo Butyl Rubber: BIIR), polybutadiene (BR), styrene-butadiene rubber (copolymer of polystyrene and polybutadiene, SBR), nitrile rubber (copolymer of polybutadiene and acrylonitrile, NBR), hydrogenated nitrile rubbers (HNBR), and chloroprene rubbers (CR). Saturated rubbers may include EPM (ethylene propylene rubber, a copolymer of ethylene and propylene), EPDM rubber (ethylene propylene diene rubber a terpolymer of ethylene, propylene and a diene-component), epichlorohydrin rubber (ECO), polyacrylic rubber (ACM, ABR), silicone rubber (SI, Q, VMQ) fluorosilicone rubber (FVMQ), fluoroelastomers (FKM, and FEPM), perfluoroelastomers (FFKM), polyether block amides (PEBA), chlorosulfonated polyethylene (CSM), (Hypalon), ethylene-vinyl acetate (EVA). The resilient material from which the spacer 110 is formed should be durable in a commercial setting where it is to be used many times per day and needs to return to original form very quickly to be used by the next customer.

As can best be seen in FIGS. 8A-9D, the spacer 110 may have a variable spacer thickness 120 defined between the first spacer surface 116 and the second spacer surface 118. The variable spacer thickness 120 may be defined perpendicularly to the second spacer surface 118 and may span at least a majority of a length the second spacer surface 118 between the first spacer end 112 and the second spacer end 114. The spacer 110 may include a maximal uncompressed spacer thickness 122 located approximately midway between the first spacer end 112 and the second spacer end 114. The maximal uncompressed spacer thickness 122 may ideally be less than or equal to 3 inches.

Figure 6:
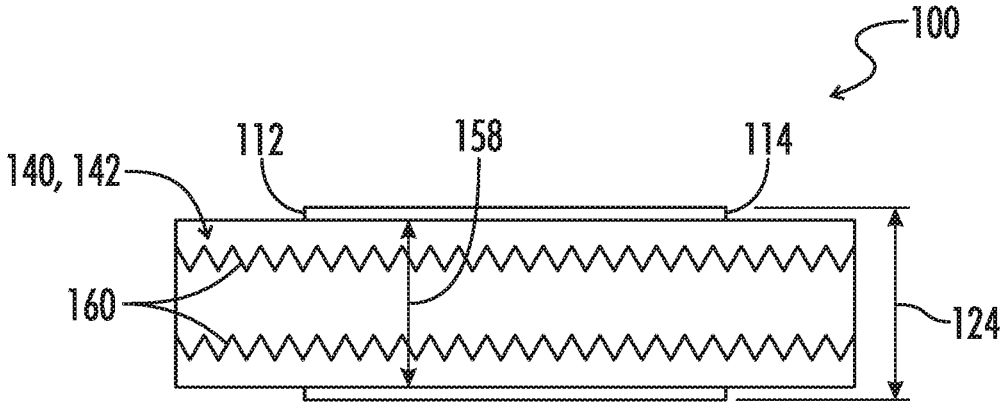
FIG. 6 illustrates a top plan view of the apparatus of FIG. 4.
Figure 7:
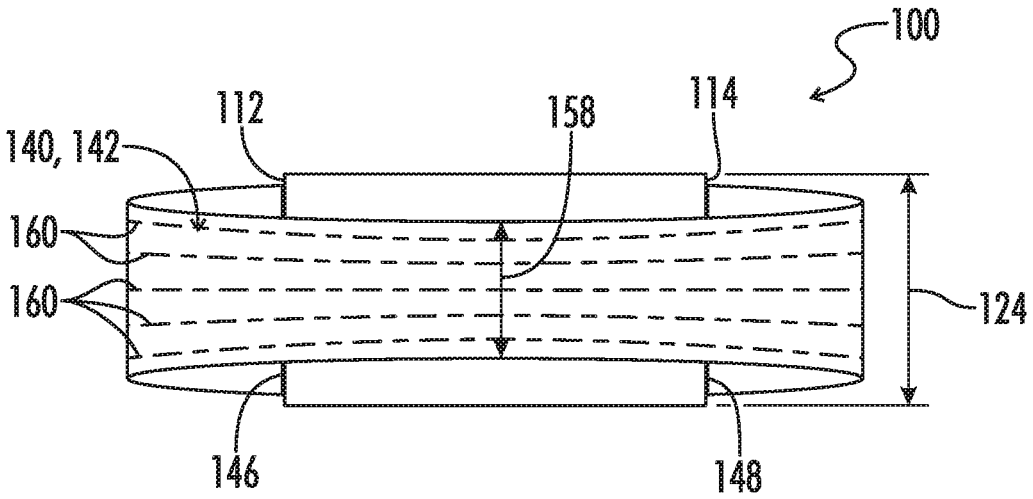
FIG. 7 illustrates a top plan view of the apparatus of FIG. 5.

As can best be seen in FIGS. 6 and 7, the spacer 110 includes a spacer width 124. Ideally, the spacer width 124 may be less than or equal to a watchband width 30 (FIG. 1) of the watchband 24 of the wristwatch 20 so that the spacer 110 is not viewable when wearing the wristwatch 20 over the apparatus 100. For men's wristwatches, this generally equates to the spacer width 124 being less than or equal to 3 inches. For women's wristwatches, this generally equates to the spacer width 124 being less than or equal to 2 inches.

In other embodiments, the spacer width 124 may be greater than or equal to the watchband width 30 so that the watchband 24 is stable upon the spacer 110 (e.g., wide enough so that the watchband 24 does not slip off or tip off the spacer 110). For men's wristwatches, this generally equates to the spacer width 124 being greater than or equal to 0.5 inch. For women's wristwatches, this generally equates to the spacer width 124 being greater than or equal to 0.3 inch.

Figure 13A:
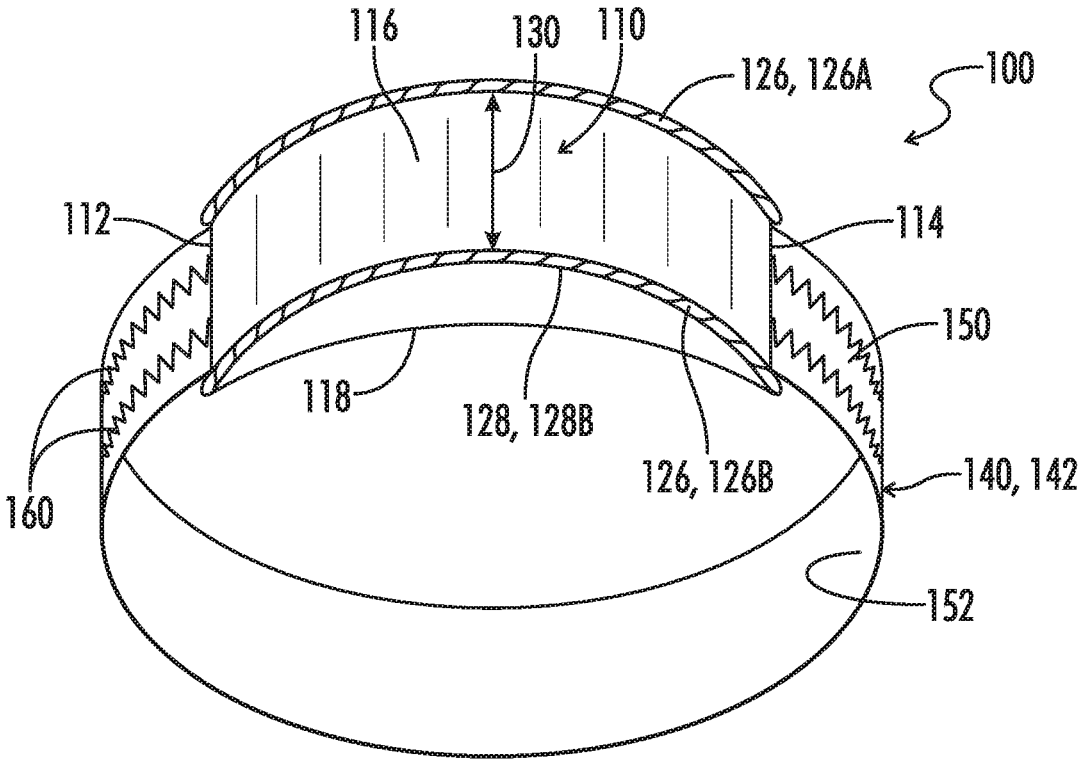
FIG. 13A illustrates a lower perspective view of an embodiment of the apparatus of FIG. 4 with ridges extending from opposite edges of an outer surface of a spacer of the apparatus in accordance with the present disclosure.
Figure 13B:
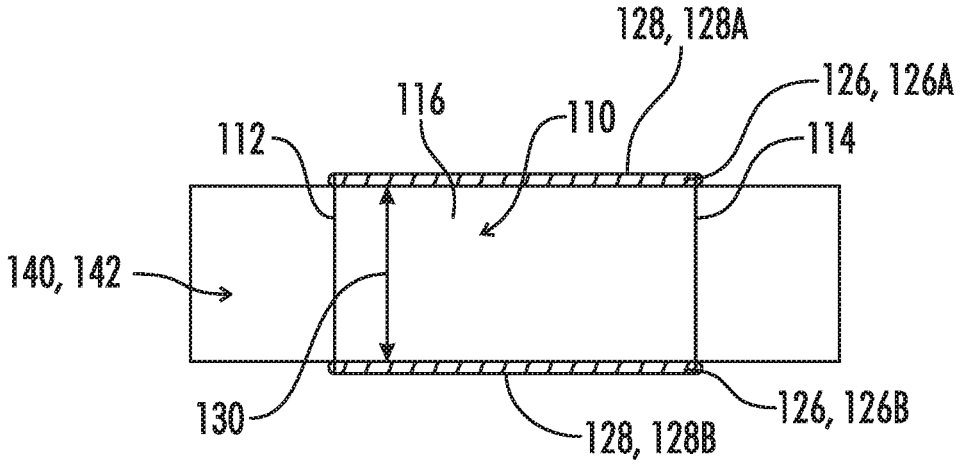
FIG. 13B illustrates a bottom plan view of the apparatus of FIG. 13A.

As can best be seen in FIG. 13A, in addition to the spacer width 124 being greater than or equal to a watchband width 30 for stabilizing the watchband 24, the spacer 110 may include a pair of ridges 126 (i.e., first and second ridges 126A, 126B) positioned to ensure that the watchband 24 does not slip off the spacer 110. As can best be seen in FIG. 13B, the pair of ridges 126 may extend radially from the first spacer surface 116 adjacent to opposite edges 128 (i.e., first and second edges 128A, 128B), respectively. The opposite edges 128 span between the first and second spacer ends 112, 114 and are separated by the spacer width 124. For example, the first ridge 126A may extend radially from the first spacer surface 116 along the first edge 128A and the second ridge 126B may extend radially from the first spacer surface 116 along the second edge 128B. When the pair of ridges 126 are included, the spacer width 124 may be greater than the watchband width 30.

The pair of ridges 126 may be spaced apart by a ridge spacing width 130. The ridge spacing width 130 may be defined parallel to the space width 124. The ridge spacing width 130 may ideally be greater than or equal to the watchband width 30 along the lower watchband portion 26. Such a ridge spacing width 130 allows the lower watchband portion 26 to rest securely along the first spacer surface 116 between the pair of ridges 126.

As can best be seen in FIGS. 2-13B, the attachment means 140 of the apparatus 100 may comprise a band 142 couplable to the spacer 110. The band 142 is configured to at least partially define a passageway 144 (FIGS. 4B and 5) configured to receive the user's wrist 10 for holding the spacer 110 along the lower wrist portion 14 of the user's wrist 10.

As can best be seen in FIGS. 2-5, 7-8B, and 10-12, the band 142 may include a first band end 146 and a second band end 148. The first band end 146 may be connected to the first spacer end 112 and the second band end 148 may be connected to the second spacer end 114. Accordingly, the passageway 144 is partially defined by the band 142 and partially defined by the spacer 110 in this embodiment.

In an alternate embodiment, as can best be seen in FIGS. 9A-9D, the band may form a continuous loop (e.g., not having the first and second band ends 146, 148). As can best be seen in FIGS. 9A and 9B, an outer band surface 150 of the band 142 may be coupled to the second spacer surface 118 such that the passageway 144 is entirely defined by the band 142. As can best be seen in FIGS. 9C-9D, an inner band surface 152 of the band 142 may be coupled to the first spacer surface 116 such that the passageway 144 is defined partially by the inner band surface 152 and partially by the second spacer surface 118. In other embodiments (not shown), the band 142 may divide the spacer into two pieces sandwiched on either side of the band 142. This potential configuration allows for substantially equal amounts of cushioning to be possible on either side of the spacer 110.

The passageway 144 includes a circumference 154. The wrist circumference 16 of 95% of adult men ranges between 5.8 inches and 8.7 inches. The wrist circumference 16 of 95% of adult women ranges between 5 and 7.5 inches. In some embodiments of the apparatus 100, the band 142 is made from a resilient material. In other embodiments (not shown), the circumference 154 of the passageway 144 may be adjusted to the wrist circumference 16 of the user's wrist 10 using some sort of adjustment mechanism (not shown) attached to the band 142. The adjustment mechanism could utilize Velcro, hook and loop fasteners, buttons, or some type of slide-fitting clasp with a release on it that allows for the passageway 144 to be easily adjustable. In still further embodiments (not shown), the band 142 may include a first Velcro half and a second Velcro half that overlap for adjustment of the circumference 154 of the passageway 144. The circumference 154 of the passageway 144 may be greater than or equal to 3 inches and less than or equal to 12 inches any of the aforementioned embodiments. The circumference 154 of the passageway 144 utilizing a resilient band may on average be smaller than the circumference 154 when utilizing an adjustable band The band 142 and the spacer 110 define an outer perimeter 156. The outer perimeter 156 should generally be greater than or equal to 4 inches and less than or equal to 14 inches.

Figure 4B:
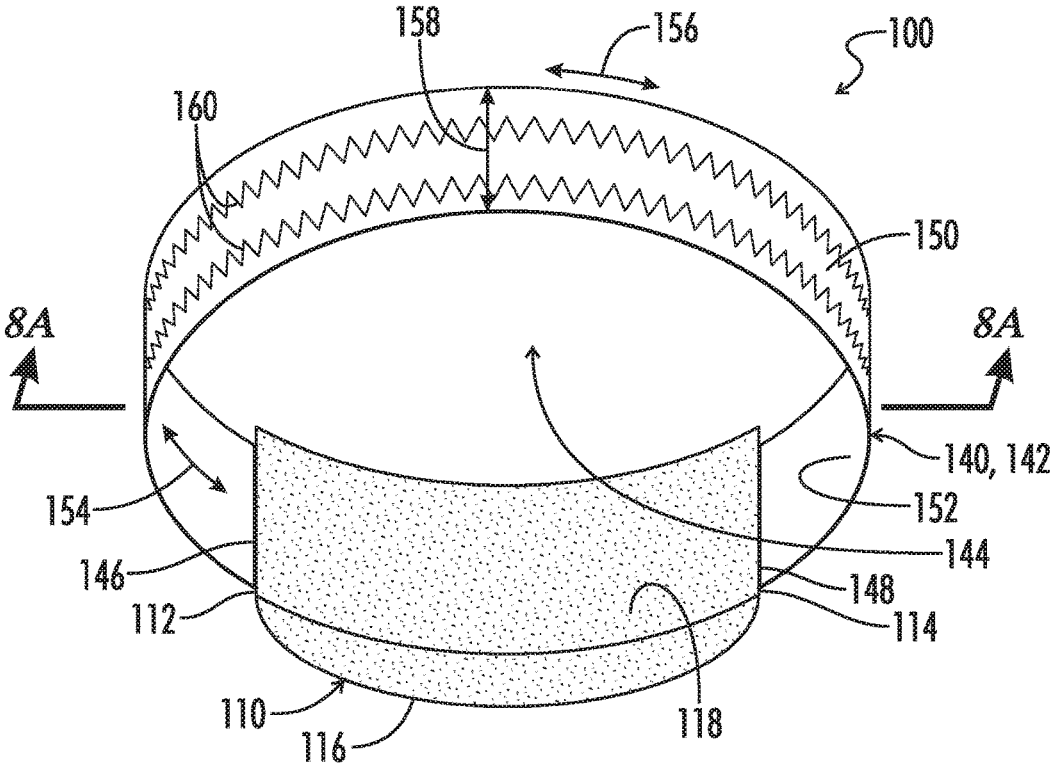
FIG. 4B illustrates a perspective view of the apparatus of FIG. 2 including a band having a uniform width.
Figure 5:
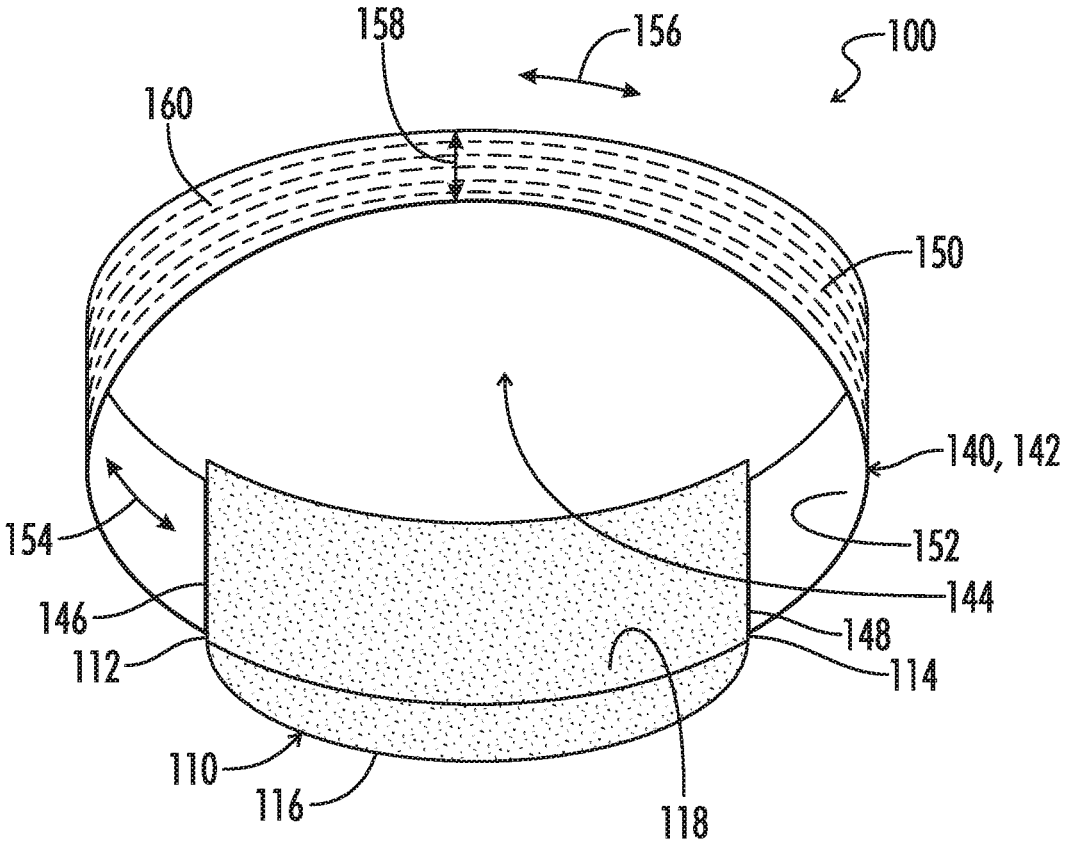
FIG. 5 illustrates a perspective view of the apparatus of FIG. 2 including a band having a variable width.

As can best be seen in FIGS. 4B and 5, at least a portion of the circumference 154 of the passageway 144 is defined by the inner band surface 152 of the band 142. A majority of the portion of the circumference 154 defined by the band 142 has a band width 158 that is less than or equal to the watchband width 30. Ideally, the band width 158 is less than or equal to 3 inches. More ideally, for male users, the band width 158 may generally be less than or equal to 2 inches so that the band is not visible along either edge of the watchband 24. More ideally, for female users, the band width may generally be less than or equal to 1 inch so that the band is not visible along either edge of the watchband 24.

As can best be seen in FIGS. 4B and 6, the band width 158 is substantially constant. As can best be seen in FIGS. 5 and 7, the band width 158 varies along a majority of the portion of the circumference 154 defined by the band 142. The variable band width 158 may allow for the band to be visible along a lower wrist portion 14 of the user's wrist 10 to better connect with the spacer 110 and also be hidden along an upper portion 12 of the user's wrist 10. An average width of the band width 158 when the band varies along a majority of the circumference 154 should ideally be less than or equal to 2 inches for men and less than or equal to 1 inch for women.

This variable band width may allow for the apparatus to be sold in unisex sizing such that the band 142 will also be hidden along an upper portion 12 of the user's wrist 10 regardless of the sex of the user. It should be noted, that a band 142 of the apparatus 100 having substantially constant band width 158 may be sold as unisex if the band width 158 is selected such that the band would remain hidden from sight regardless of the sex of the user.

The band 142 may be formed from any suitable material. In certain embodiments where the band 142 is resilient, the band 142 may be any of a knit elastic material, a rubber/latex material, a neoprene material, spandex or a spandex blend material, or the like. When the band 142 is resilient and formed from an abrasive material such as rubber, the band 142 may further include a soft but durable fabric covering (not shown). This covering may lead to a more luxury feel of the apparatus 100. In some embodiments wherein the band 142 is not resilient, the band may be any other suitable material such as nylon, cotton, or the like. In other embodiments, the band 142 may be fashioned from a nonporous material for hygienic purposes. In some embodiments (not shown), the band 142 may be a prime advertising location and may include marketing information about the retailer, or the specific watches sold, such as logos, product names, or the like.

As can best be seen in FIGS. 4B-7, 11, and 13, the outer band surface 150 includes a non-slip material 160 disposed thereon (e.g., the band 142 may include a non-slip outer surface). The non-slip material 160 disposed on the outer band surface 150 may be configured to engage the wristwatch 20 when worn on the user's wrist 10 (e.g., when modeling or trying on the wristwatch 20). The non-slip material 160 may be silicon, rubber, or a like material having elastic properties and non-slip properties for enabling the outer band surface 150 to be resistant to slippage of the wristwatch 20 and/or watchband 24. The non-slip material 160 may be applied to the outer band surface 150 according to a pattern such as a zig-zag pattern (FIGS. 4B, 6, 11, and 13), a dashed pattern (FIGS. 5 and 7), or some other pattern.

Figure 14:
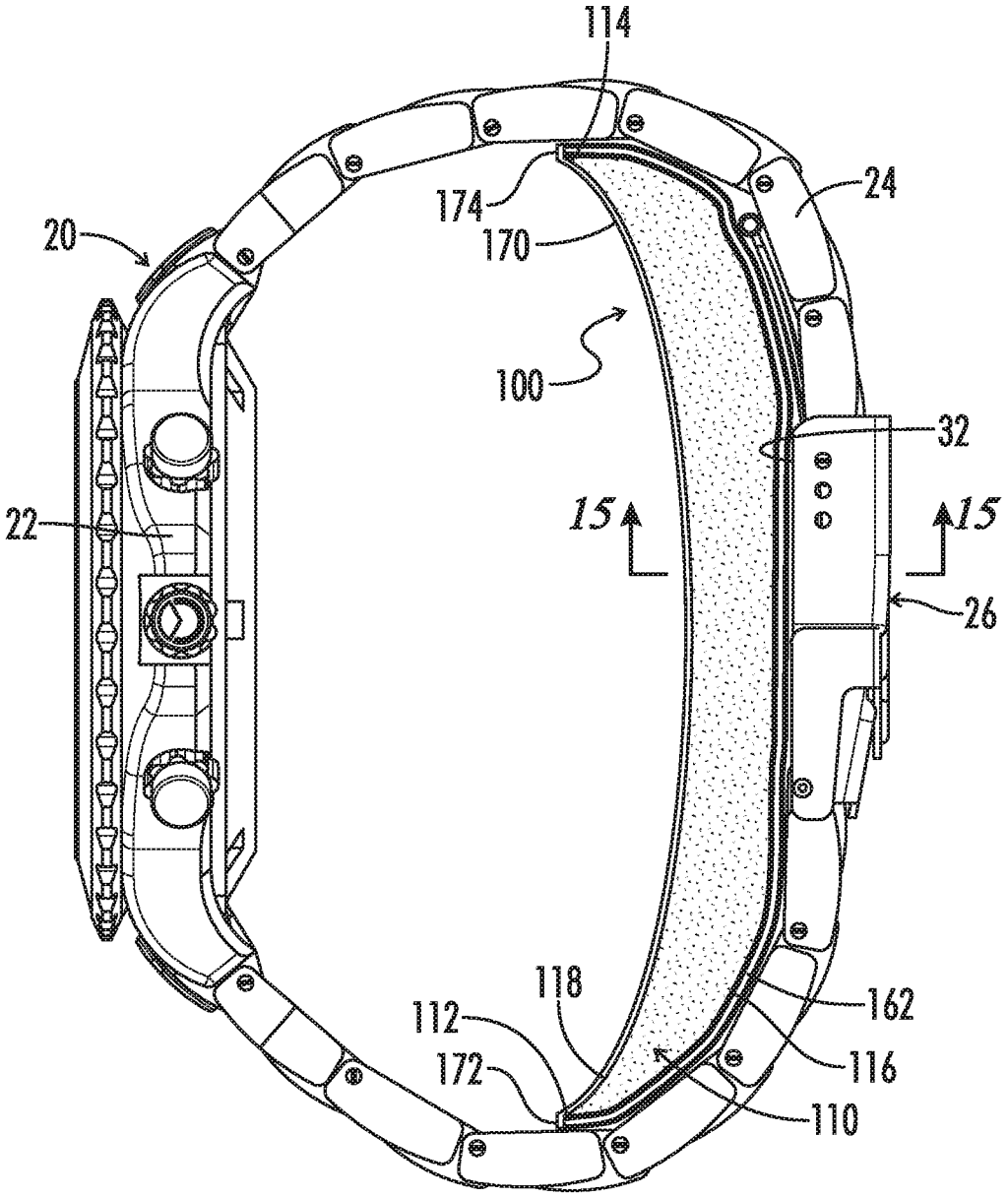
FIG. 14 illustrates a side elevational view of an apparatus in combination with a wristwatch in accordance with the present disclosure.
Figure 15:
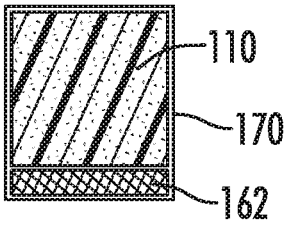
FIG. 15 illustrates a cross-sectional view of the apparatus of FIG. 14 taken along line 15-15 of FIG. 14.

Alternatively, as can best be seen in FIGS. 14 and 15, the attachment means 140 of the apparatus 100 may comprise at least one magnet 162. The apparatus 100 as shown in FIG. 14 is cross-sectioned, while the wristwatch 20 is not. The at least one magnet 162 may be connected to the first spacer surface 116. The at least one magnet 162 may be configured to magnetically connect with an interior surface 32 of the watchband 24 (e.g., along an interior surface of the lower watchband portion 26 of the watchband 24 of the wristwatch 20). The magnetic interaction with the watchband 24 enables the apparatus 100 to remain situated between the lower wrist portion 14 and the lower watchband portion 26. The at least one magnet 162 may be a continuous flexible magnet that matches the curvature of the first spacer surface 116 (as illustrated) or may be a plurality of magnets (not shown) joined together to match the curvature of the first spacer surface 116.

In a still further embodiment (not shown), the spacer 110 may be positioned between the lower wrist portion 14 and the lower watchband portion 26 without any additional attachment means 140 as described above. In other words, the spacer 110 may remain between the lower wrist portion 14 and the lower watchband portion 26 solely based upon frictional compression.

Referring now to FIGS. 8A-10 and 12, the apparatus 100 may further comprise a cover 170. The cover 170 is configured to at least surround the spacer 110. The cover includes a first cover end 172 and a second cover end 174. The first cover end 172 is positioned to cover the first spacer end 112. The second cover end 174 is configured to cover the second spacer end 114. According, the first and second cover ends 172, 174 correspond to the first and second spacer ends 112, 114. The cover 170 is configured to protect the spacer from excessive wear and tear while also acting as a hygienic barrier.

As can best be seen in FIGS. 9A-9D, the cover 170 may be configured to couple the spacer 110 and the band 142 together when the band 142 forms a continuous loop. As previously mentioned, the first band end 146 of the band 142 may be connected to the first spacer end 112 of the spacer 110 and the second band end 148 may be connected to the second spacer end 114. Alternatively, as can best be seen in FIG. 8B, the first band end 146 of the band 142 may be coupled to the first cover end 172 and the second band end 148 of the band 142 may be coupled to the second cover end 174. In other embodiments (not shown), the cover 170 may include features such as a Velcro opening or seam to allow the spacer 110 to be easy removed and replaced. The spacer 110 may be a solid piece of material or may be fill type of material (not shown) configured to fill the cover 170.

The cover 170 should be made of some sort of luxury material such as leather, luxury vinyl, suede or the like. Additionally, the cover 170 could be made of some other fabric material that is durable, yet soft, pliable, and comfortable. In some embodiments (not shown), the cover 170 may be a prime advertising location and may include marketing information about the retailer, or the specific watches sold, such as logos, product names, or the like. The cover 170 may be formed from a material that is inherently non-slip. Alternatively, the cover 170 may include a non-slip material (not shown) disposed on an outer surface thereof (e.g., similar to the non-slip material 160 of the band 142). The cover 170 material should be durable, non-scratching, and non-porous so that it can easily be cleaned and will serve hygienic purposes to not absorb any skin oils from a potential user.

Figure 10:
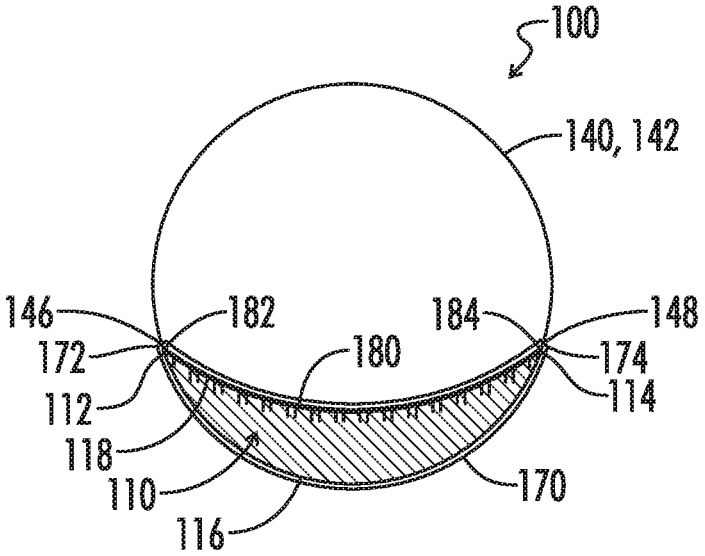
FIG. 10 illustrates a cross-sectional view of an embodiment of the apparatus of FIG. 8A with a linkage connected between first and second ends of a spacer of the apparatus in accordance with the present disclosure.

As can best be seen in FIG. 10, the apparatus 100 may further include a linkage 180 spanning between the first space end 112 and the second spacer end 114. The linkage 180 includes a first linkage end 182 and a second linkage end 184. The linkage 180 may be configured to connect at the first linkage end 182 to the first band end 146 and may be configured to connect at the second linkage end 184 to the second band end 148. The linkage 180 may be implemented in the apparatus 100 to reduce or eliminate tensile stress on the spacer 110 which may be caused by the band 142 pulling on the first and second space ends 112, 114.

The linkage 180 is configured to be positioned between the second spacer surface 118 and the cover 170. As illustrated, the linkage 180 is connected to the second spacer surface 118. In other embodiments (not shown), the linkage 180 may be connected to the cover 170. The linkage 180 may be pre-molded to match the second radius of curvature and/or may be formed from a flexible material that is substantially resistive to stretching (e.g., rubber, plastic, nylon, or the like). In other embodiments (not shown), the linkage 180 may be more reminiscent of a spine and be comprises of a plurality of linked pieces which may be formed from any applicable material including metal.

Figure 11:
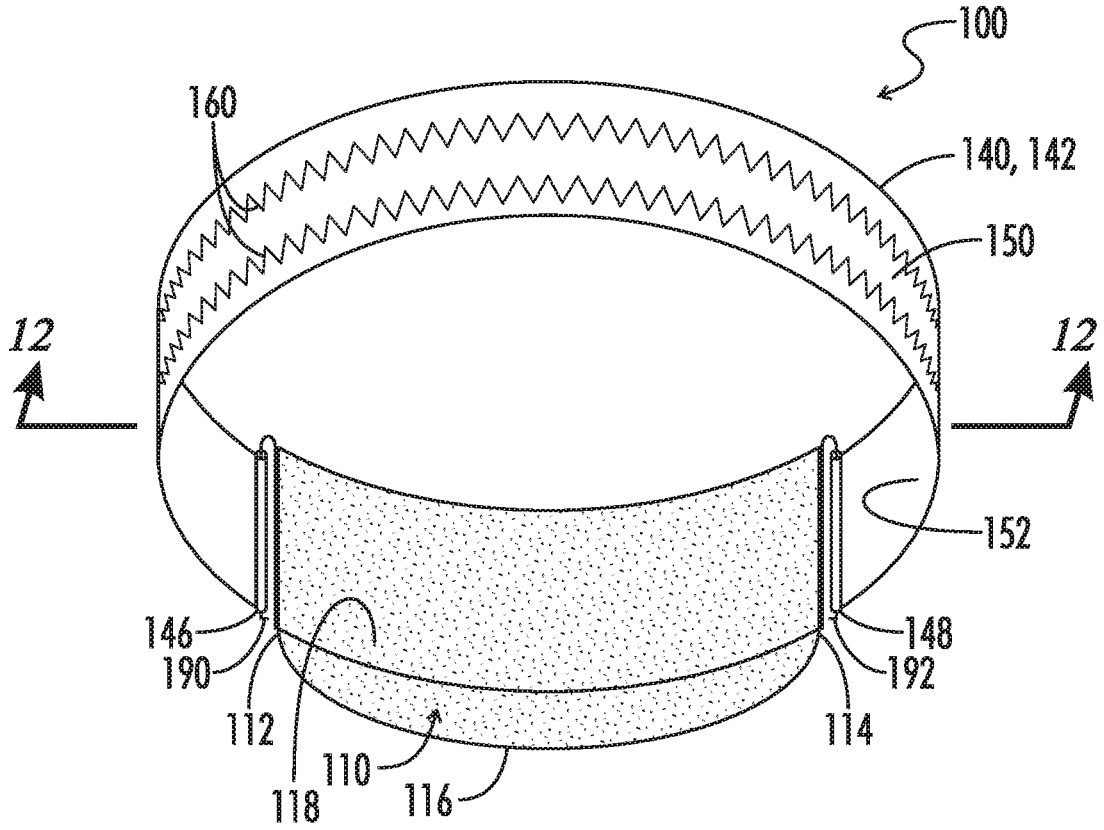
FIG. 11 illustrates a perspective view of an embodiment of the apparatus of FIG. 4 with connectors extending from first and second ends of a spacer of the apparatus in accordance with the present disclosure.
Figure 12:
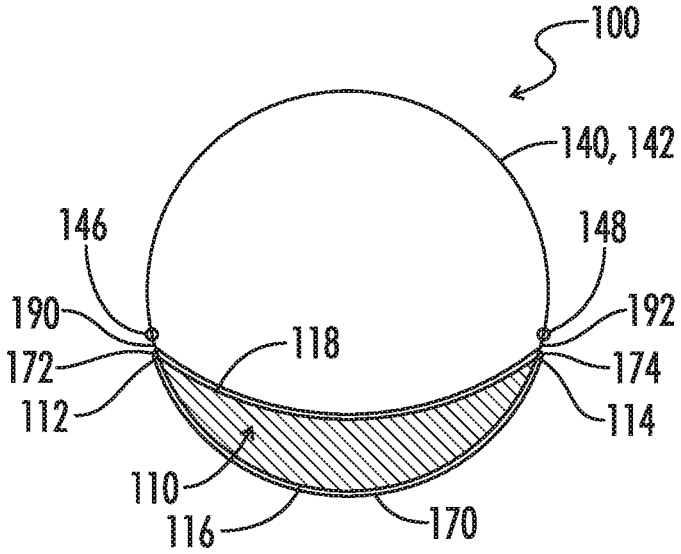
FIG. 12 illustrates a side elevational view of the apparatus of FIG. 11 taken along line 12-12 of FIG. 11.

In certain embodiments, as can best be seen in FIGS. 11 and 12, the apparatus 100 may include a first connector 190 positioned at the first spacer end 112 and a second connected 192 positioned at the second spacer end 114. As illustrated, the first connector 190 is connected to the first spacer end 112 and the second connector 192 is connected to the second spacer end 114. The first and second connectors 190 are configured to allow the band 142 to be removably coupled to the spacer 110. In such an embodiment, the first and second band ends 146, 148 comprise loops for engaging the first and second connectors 190, 192.

In other embodiments (not shown), the first connector 190 may be coupled to the first cover end 172 or the first linkage end 182. Likewise, in such embodiments, the second connector 192 may be coupled to the second cover end 174 or the second linkage end 184. The first and second connectors 190, 192 may be a metal bra strap hook or some other similar hook having a substantially linear hook portion.

In certain embodiments, each main component (i.e., the spacer 110, the band 142, the cover 170, or the like) of the apparatus 100 may be separable so that it may easily be replaced based on wear and tear. In other embodiments, certain components may be permanently coupled together and may have to both be replaced when one wears out. It is likely that the band 142 will wear out first. Accordingly, replacement bands 142 will be available a la carte.

A method for modeling the wristwatch 20 on the user's wrist 10 is also provided herein. The method includes selecting a spacer 110 from a plurality of spacers having differing maximal uncompressed spacer thicknesses defined between first and second spacer surfaces 116, 118 and positioned approximately midway between first and second spacer ends. The selected spacer 110 has a maximal uncompressed thickness 122 that is greater than or equal to a maximal gap distance 42 defined between a lower wrist portion 14 of the user's wrist 10 and a lower watchband portion 26 of the wristwatch 20.

The method further comprises positioning the selected spacer 110 between the lower wrist portion 14 of the user's wrist 10 and the lower watchband portion 26 of the wristwatch 20 for holding a case 22 of the wristwatch proximate to and securely along an upper wrist portion 12 of the user's wrist 10.

The method may further comprise positioning the user's wrist 10 through a passageway 144 defined at least partially by a band 142 coupled to the spacer 110. And may still further comprise positioning the wristwatch 20 and the watchband 24 around the spacer 110 and the band 142.

The method may further comprise disposing a non-slip material 160 along at least a portion of an outer band surface 150 of the band 142 coupled to the spacer 110 for maintaining a position of the wristwatch 20 and the watchband 24 along the user's wrist 10.

It is noted that the method may include additional steps consistent with the previous description.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An apparatus for positioning between a watch and a user's wrist, the apparatus comprising:

a spacer configured to be positioned between a base portion of a watchband of the watch and a lower portion of the user's wrist;

a cover configured to surround and protect the spacer; and a band couplable to the spacer, the band configured to at least partially define a passageway configured to receive the user's wrist for holding the spacer along the lower portion of the user's wrist.

2. The apparatus of claim 1, wherein:

the spacer includes a first spacer end, a second spacer end, a spacer width, a first support surface, and a second support surface;

the first and second support surfaces are defined between the first spacer end and the second spacer end; and the first spacer support surface includes a first radius of curvature.

3. The apparatus of claim 2, wherein:

the second spacer support surface includes a second radius of curvature; and the first radius of curvature is smaller than the second radius of curvature.

4. The apparatus of claim 2, wherein:

a variable spacer thickness is defined between the first support surface and the second support surface; and the variable spacer thickness is defined perpendicularly to the second support surface and spans a majority of the second support surface between the first spacer end and the second spacer end.

5. The apparatus of claim 2, wherein a maximal uncompressed spacer thickness is defined between the first support surface and the second support surface approximately midway between the first spacer end and the second spacer end.

6. The apparatus of claim 5, wherein the maximal uncompressed spacer thickness is less than or equal to 3 inches.

7. The apparatus of claim 2, wherein the spacer width is greater than or equal to 0.3 inch and less than or equal to 2 inches.

8. The apparatus of claim 2, wherein the band extends between the first and second spacer ends.

9. The apparatus of claim 2, wherein the spacer includes a pair of ridges extending radially from the first support surface of the spacer positioned adjacent a first edge and a second edge of the first support surface, respectively, the first and second edges spanning between the first spacer end and the second spacer end.

10. The apparatus of claim 9, wherein:

the pair of ridges are spaced apart by a ridge spacing width; and the ridge spacing width is greater than or equal to a watchband width of the base portion of the watchband.

11. The apparatus of claim 1, wherein:

the band is resilient.

12. The apparatus of claim 1, wherein:

the passageway has a circumference greater than or equal to 3 inches and less than or equal to 12 inches.

13. The apparatus of claim 1, wherein:

the band and the spacer define an outer perimeter having a perimeter distance greater than or equal to 4 inches and less than or equal to 14 inches.

14. The apparatus of claim 1, wherein:

at least a portion of a circumference of the passageway is defined by the band; and a majority of the portion of the circumference defined by the band has a band width that is less than or equal to 2 inches.

15. The apparatus of claim 14, wherein:

the band width varies along a majority of the portion of the circumference defined by the band.

16. The apparatus of claim 1, wherein the cover is configured to couple the spacer and the band together.

17. The apparatus of claim 1, wherein the band includes a non-slip outer surface, the non-slip outer surface being configured to engage the watch when worn on the user's wrist.

18. A watch accessory for maintaining an optimal position of a wristwatch on a user's wrist, the watch accessory comprising:

a spacer having a first spacer end, a second spacer end, a first spacer surface, and a second spacer surface, the first and second spacer surfaces spanning between the first spacer end and the second spacer end, the first spacer surface defined by a first radius of curvature;

a cover configured to surround the spacer, the cover having first and second cover ends corresponding to the first and second spacer ends; and an attachment means for positioning the spacer between an underside of the user's wrist and a watchband of the wristwatch.

19. The watch accessory of claim 18, wherein:

the attachment means comprises at least one magnet positioned between first spacer surface and the cover; and the at least one magnet being configured to couple to an interior surface of the watchband.

20. The watch accessory of claim 18, wherein:

the attachment means comprises a band having a first band end and a second band end;

the first band end coupled to one of the first spacer end or the first cover end; and the second band end coupled to one of the second spacer end or the second cover end.

21. The watch accessory of claim 20, wherein:

the band includes a linkage coupled between the first band end and the second band end; and the linkage is configured to be positioned between the second spacer surface and the cover.

* * * * *